US006142853A

United States Patent [19]

Freund et al.

[11] Patent Number: 6,142,853

[45] Date of Patent: Nov. 7, 2000

[54] METHOD AND APPARATUS FOR HOLDING LASER WAFERS DURING A FABRICATION PROCESS TO MINIMIZE BREAKAGE

[75] Inventors: Joseph Michael Freund, Fogelsville; George John Przybylek, Douglasville; Dennis Mark Romero, Allentown, all of Pa.

[73] Assignee: Lucent Technologies, Inc., Murray Hill, N.J.

[21] Appl. No.: 09/219,785

[22] Filed: Dec. 23, 1998

[51] Int. Cl.[7] ..... B24B 1/00

[52] U.S. Cl. ..... 451/53; 451/364; 451/460

[58] Field of Search ..... 451/41, 54, 63, 451/364, 390, 398, 285, 286, 287, 289, 460, 7, 53

[56] References Cited

U.S. PATENT DOCUMENTS

| | | | |
|---|---|---|---|
| 3,809,050 | 5/1974 | Chough et al. | 125/35 |
| 4,098,031 | 7/1978 | Hartman et al. . | |
| 4,258,508 | 3/1981 | Wilson et al. | 51/283 R |
| 4,519,168 | 5/1985 | Cesna | 51/216 LP |
| 5,392,304 | 2/1995 | Tanaka et al. . | |
| 5,538,465 | 7/1996 | Netsu et al. | 451/397 |
| 5,573,448 | 11/1996 | Nakazima et al. | 451/41 |
| 5,769,696 | 6/1998 | Lee et al. | 451/287 |
| 5,788,560 | 8/1998 | Hashimoto et al. | 451/288 |
| 5,791,975 | 8/1998 | Cesna et al. | 451/63 |

*Primary Examiner*—Timothy V. Eley
*Assistant Examiner*—Dung Van Nguyen
*Attorney, Agent, or Firm*—Dickstein Shapiro Morin & Oshinsky LLP

[57] ABSTRACT

A method and apparatus utilizing a thermal release mounting material to adhere a laser wafer to a wafer support during a semiconductor fabrication process is provided. A first surface of the mounting material contains an adhesive and is adhered to a wafer support. The wafer support contains apertures for allowing air bubbles to escape while the mounting material is being applied to the wafer support, thus, ensuring that the film is planar to the support. The laser wafer is adhered to a second surface of the mounting material. The second surface of the mounting material comprises a thermal release material. After undergoing the fabrication process, the thermal release material of the mounting material is heated to a release temperature allowing the laser wafer to be readily removed from the wafer support.

29 Claims, 5 Drawing Sheets

METHOD AND APPARATUS FOR HOLDING LASER WAFERS DURING A FABRICATION PROCESS TO MINIMIZE BREAKAGE

BACKGROUND OF THE INVENTION

1. Field of the Invention

The present invention relates to the field of laser device fabrication and, more particularly to a method and apparatus for holding laser wafers during a semiconductor fabrication process to minimize breakage of the wafers.

2. Description of the Related Art

Semiconductor laser devices are used in a wide variety of today's applications. These applications include, but are not limited to, optical telecommunications, stereo equipment, optical storage and printing devices. Examples of the laser devices used in these applications are fiber optic transmitters, compact disc (CD) players, CD-ROM drives and laser printers.

Laser devices utilize laser diodes to generate light signals or waves. Laser diodes are manufactured from semiconductor substrates or wafers. Typically, the wafer used in the fabrication of laser diodes is a gallium arsenide (GaAs) wafer, although wafers with other chemical compositions are also used ("laser wafer" will be used herein to describe a semiconductor wafer from which a laser diode is fabricated).

During the fabrication of a laser diode, the laser wafer undergoes a thinning process. This process, also known in the art as lapping, takes a relatively thick laser wafer and reduces it to a desired thickness. Currently, laser wafers are reduced to a thickness of approximately four mils (i.e., four-one thousandth of an inch).

To perform the thinning process, the laser wafer is mounted onto a wafer support. The wafer support is typically a sapphire disk, but it can also be quartz or a metal plate. Wax is used as an adhesive to ensure that the laser wafer adheres to and remains mounted on the wafer support. Once mounted, the laser wafer and the wafer support are inserted into a thinning or lapping apparatus where the laser wafer is mechanically or chemically reduced to the desired thickness. Once the laser wafer is thinned, the laser wafer, which is still affixed to the support, is removed from the apparatus.

Upon completion of the process, the laser wafer is removed from the wafer support. Typically, tweezers or a stick-like object is used to remove the laser wafer from the wafer support. Since the laser wafer is very thin, e.g., approximately four mils, there is a high incidence of breakage during this step. Broken lasers wafers require additional processing steps which adds cost to the manufacturing process. Accordingly, there is a need and desire for a method and apparatus for holding laser wafers during the thinning process that minimizes breakage of the laser wafers upon removal.

In addition, since the current methods utilize wax to adhere the laser wafer to the wafer support, the laser wafer must undergo a clean up step to remove wax build-up. This is time consuming, adds cost to the manufacturing process and is not always effective. Often times, even after the clean-up step, a wax residue remains on the laser wafer making them unsuitable for use in a laser diode. Accordingly, there is a need and desire for a method and apparatus for holding laser wafers during the thinning process that does not require a clean up step upon completion of the process.

SUMMARY OF THE INVENTION

The present invention provides a method and apparatus for holding laser wafers during a fabrication process that minimizes breakage of the laser wafers upon removal.

The present invention also provides a method and apparatus for holding laser wafers during a fabrication process that does not require a clean up step upon completion of the process.

The above and other features and advantages of the invention are achieved by providing a method and apparatus utilizing a thermal release mounting material to adhere a laser wafer to a wafer support during a semiconductor manufacturing process. A first surface of the mounting material contains an adhesive and is adhered to a wafer support. The wafer support contains apertures for allowing air bubbles to escape while the mounting material is being applied to the wafer support, thus, ensuring that the film is planar to the support. The laser wafer is adhered to a second surface of the mounting material. The second surface of the mounting material comprises a thermal release material. After undergoing the fabrication process, the thermal release material of the mounting material is heated to a release temperature allowing the laser wafer to be readily removed from the wafer support.

BRIEF DESCRIPTION OF THE DRAWINGS

The foregoing and other advantages and features of the invention will become more apparent from the detailed description of the preferred embodiments of the invention given below with reference to the accompanying drawings in which.

DETAILED DESCRIPTION OF PREFERRED EMBODIMENTS

Figure 1A:
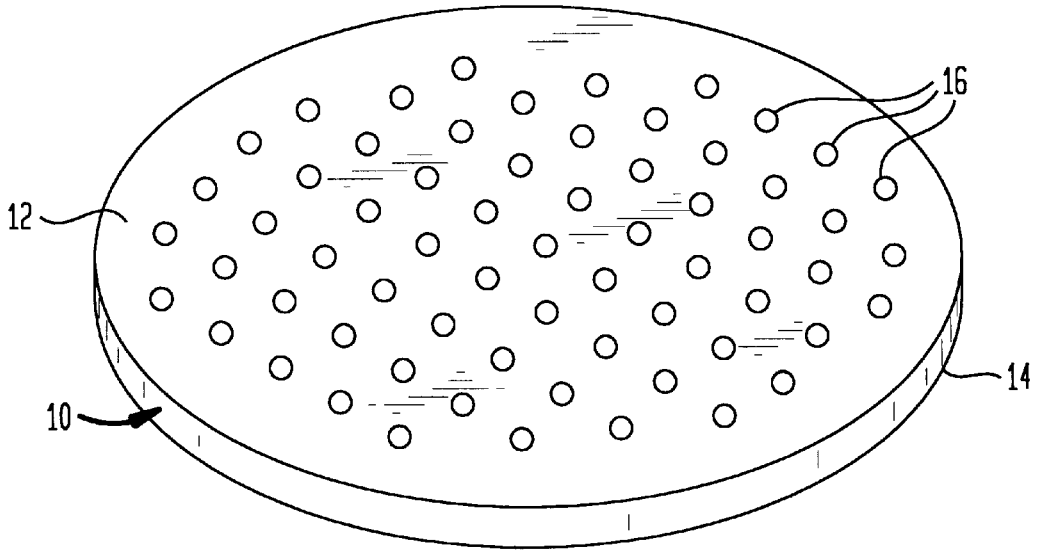
FIGS. 1*a*–1*g* illustrate a process and apparatus for holding semiconductor wafers in accordance with the present invention.

FIGS. 1*a*–1*g* illustrate a process and apparatus for holding semiconductor wafers in accordance with the present invention. FIG. 1*a* illustrates one embodiment of a wafer support 10 constructed in accordance with the present invention. Preferably, the support 10 is a disk made of sapphire, but it can also be made of quartz or a metal plate. In addition, although it is desirable for the support 10 to be circular or disk-shaped, the support 10 can be any shape.

The support 10 has first surface 12 and a second opposite surface 14. The support 10 has a plurality of apertures 16 formed therein. The apertures 16 extend from the first surface 12 to the second surface 14. The apertures 16 may be provided by any process. The utility of the apertures 16 will become apparent with reference to FIG. 1*b*.

Figure 1B:
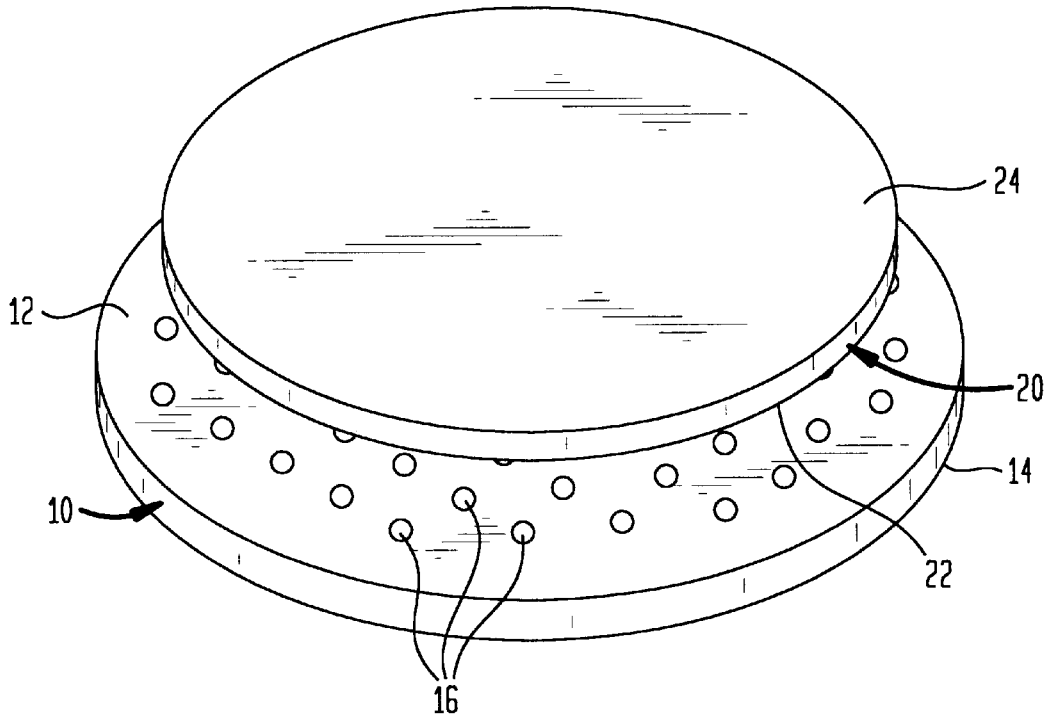

As shown in FIG. 1*b,* once the apertures 16 are formed within the support 10, a mounting material 20 is provided and adhered to the wafer support 10. It is desirable for the mounting material 20 to be made of nylon or any durable elastic or flexible material. Although it is desirable for the mounting material 20 to be circular or disk-shaped, the material 20, like the support 10, can be any shape.

The mounting material 20 has a first surface 22 and a second opposite surface 24. The first surface 22 contains a conventional adhesive. The first surface 22 of the mounting material 20 is adhered to the first surface 12 of the wafer support 10. The apertures 16 within the support 10 allow air bubbles to escape while the mounting material 20 is being applied to the support 10. This ensures that the mounting material 20 is planar to the support 10.

The second surface 24 of the mounting material 20 contains a thermal release film. As is known in the art, the thermal release film has a given adhesion. When heated to a specific temperature, however, the thermal release film loses its adhesion. The temperature at which the thermal release film loses its adhesion is typically referred to as the "release temperature." Thus, under most circumstances, the thermal release film behaves as and can be utilized as an adhesive, but when heated to the release temperature, the film no longer behaves as an adhesive.

Figure 1C:
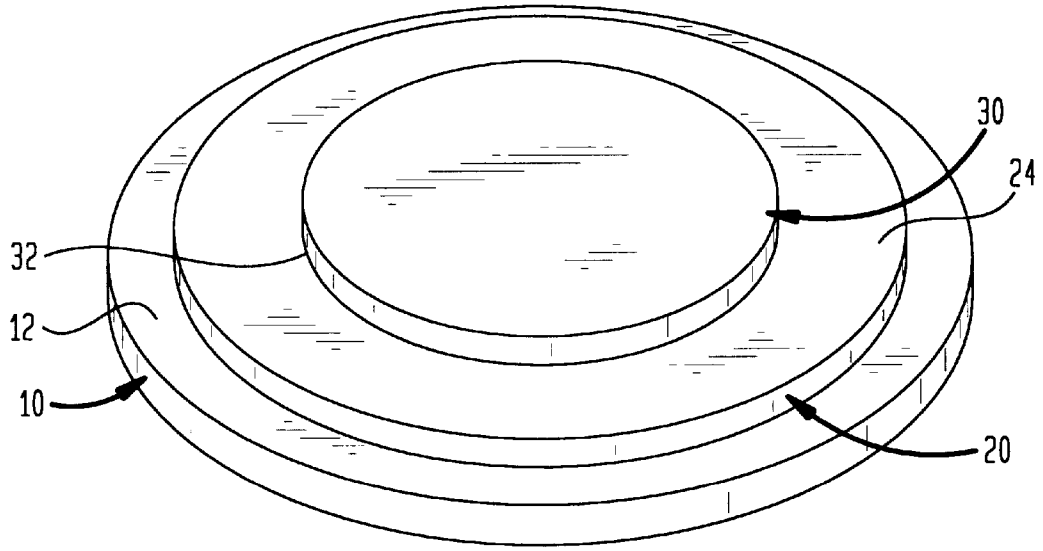

With reference to FIG. 1*c*, after the mounting material 20 is adhered to the first surface of the support 10, a semiconductor wafer 30, such as a laser wafer, is mounted onto the second surface 24 of the mounting material 20. The wafer 30 has a first surface 32 which is placed onto the second surface 24 of the mounting material 20. Since the second surface 24 of the mounting material 20 is not being heated to the release temperature, the first surface 32 of the wafer 30 remains adhered to the mounting material 20. As such, the wafer 30 is properly mounted onto the wafer support 10 and is ready to undergo a fabrication process such as the thinning process.

Figure 1D:
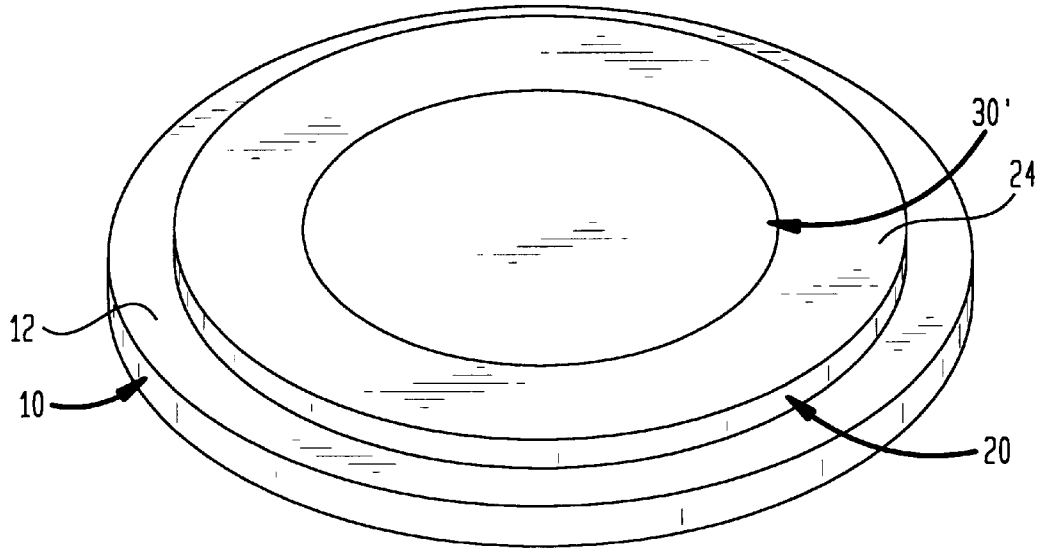

FIG. 1*d* illustrates a processed semiconductor wafer 30'. As stated earlier, laser wafers undergo a thinning process. It is during the thinning process that a laser wafer is typically reduced to a thickness of approximately four mils. This is accomplished by placing the mounted wafer 30 and support 10 (FIG. 1*c*) into a thinning or lapping apparatus. Once inside the apparatus, the laser wafer is mechanically or chemically reduced to the desired thickness. At this point, the processed wafer 30' may undergo additional processing while still mounted to the support 10. For example, a polishing process typically follows the thinning process. The processed wafer 30' can be placed into a polishing machine or other apparatus while still mounted to the support 10. Thus, the support 10 also serves as a carrier for the processed wafer 30'. Once the wafer 30' has undergone the desired processing, it will be removed from the support 10.

Figure 1E:
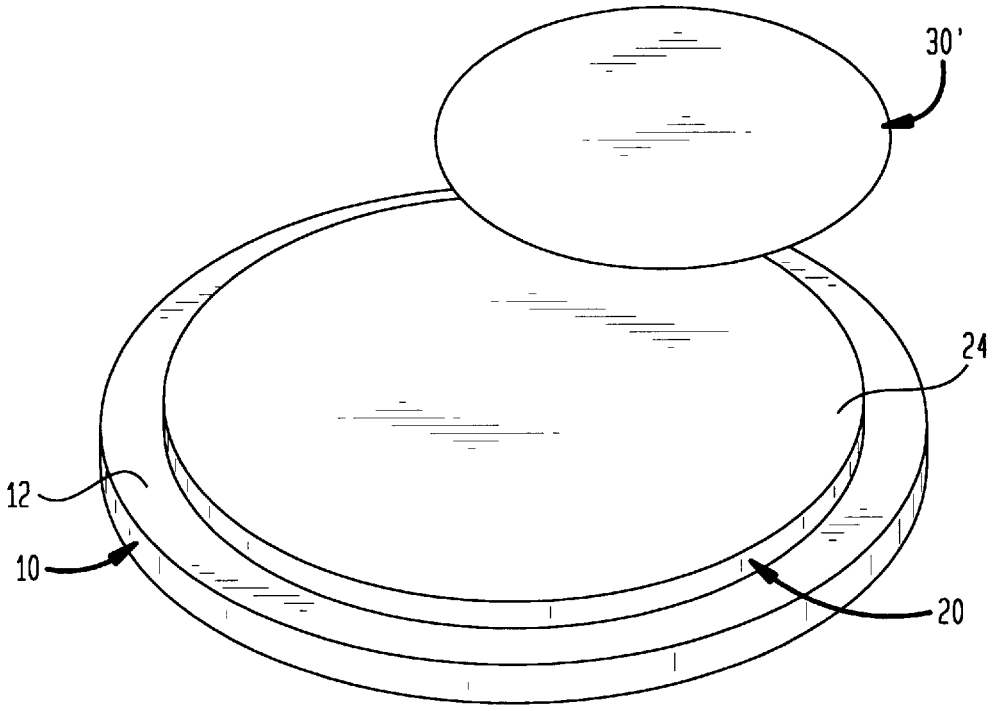

FIG. 1*e* illustrates the removal of the processed wafer 30' from the mounting material 20 and thus, the wafer support 10. The second surface 24 of the mounting material 20 is heated to the release temperature. The heat may be provided by any method. Once heated to the release temperature, the thermal release film of the second surface 24 loses its adhesion and the wafer 30' is easily removed from the mounting material 20. The prior art's high incidence of breakage is greatly minimized since the processed wafer 30' can be removed without the force required to separate the wafer 30' from wax as is currently performed in the prior art.

Figure 1F:
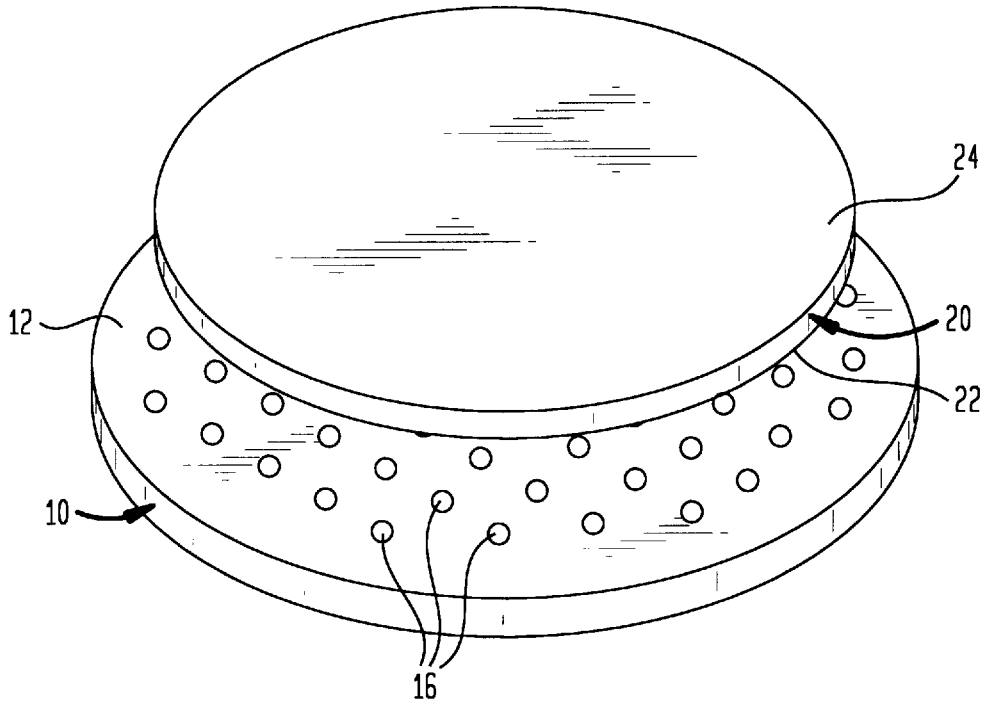
Figure 1G:
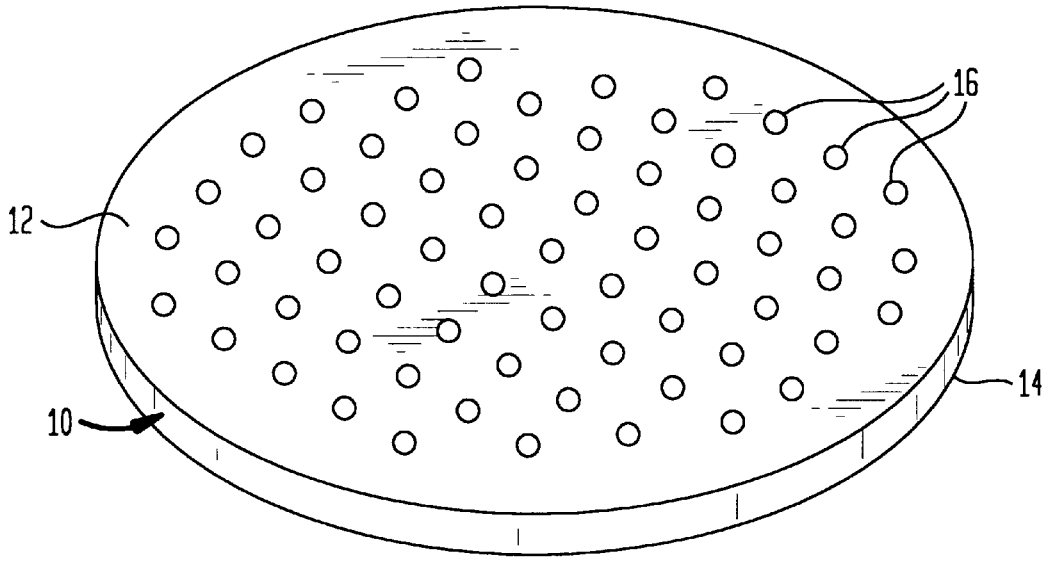

With reference to FIGS. 1*f* and 1*g*, once the wafer 30' is removed, the mounting material 20 is also removed from the wafer support 10. Once the first surface 22 of the mounting material 20 is removed from the first surface 12 of the support 10, the mounting material 20 is discarded. The wafer support 10 is reusable and is suitable for use again in the process described above with reference to FIGS. 1*a*–1*g*.

Figure 2:
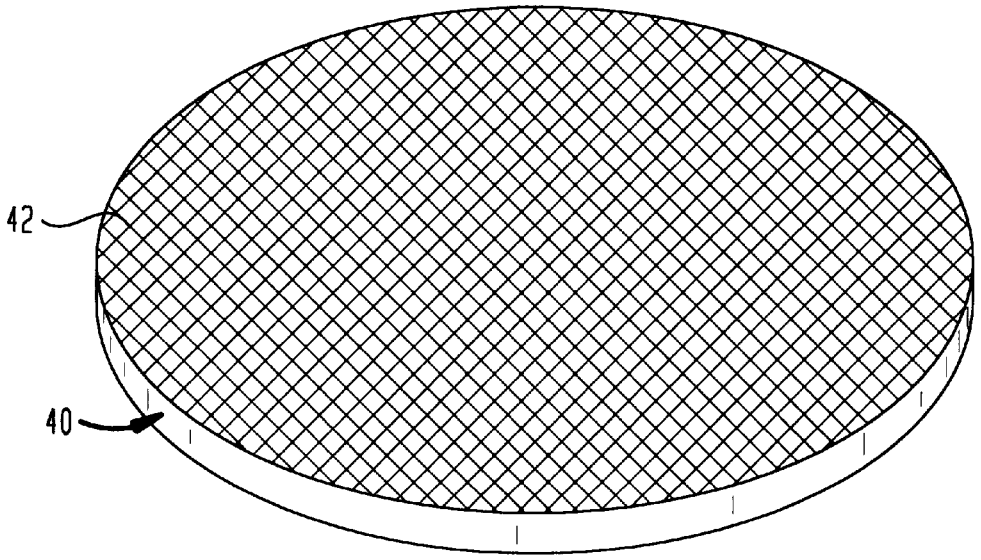
FIG. 2 illustrates a first alternative embodiment of a wafer support utilized in the process of FIGS. 1*a*–1*g;*

FIG. 2 illustrates a first alternative embodiment of a wafer support 40 which can be used in the process of FIGS. 1*a*–1*g*. Like the support 10 illustrated in FIGS. 1*a*–1*g*, the support 40 is a disk made of sapphire, but it can also be made of quartz or a metal plate. In addition, although it is desirable for the support 40 to be circular or disk-shaped, the support 40 can be any shape.

The support 40 has first surface 42. The first surface 42 contains a ground or etched "X" pattern formed thereon. As shown in FIG. 2, the ground or etched X pattern contains a plurality of X's spanning the entire region of the first surface 42. The ground or etched X pattern can be provided by a conventional grinder or by an etching process. When the first surface of the mounting material is adhered to the first surface 42 of the wafer support 40, the ground or etched X pattern allows air bubbles to escape while the mounting material is being applied to the support 40. This ensures that the mounting material is planar to the support 40.

Figure 3:
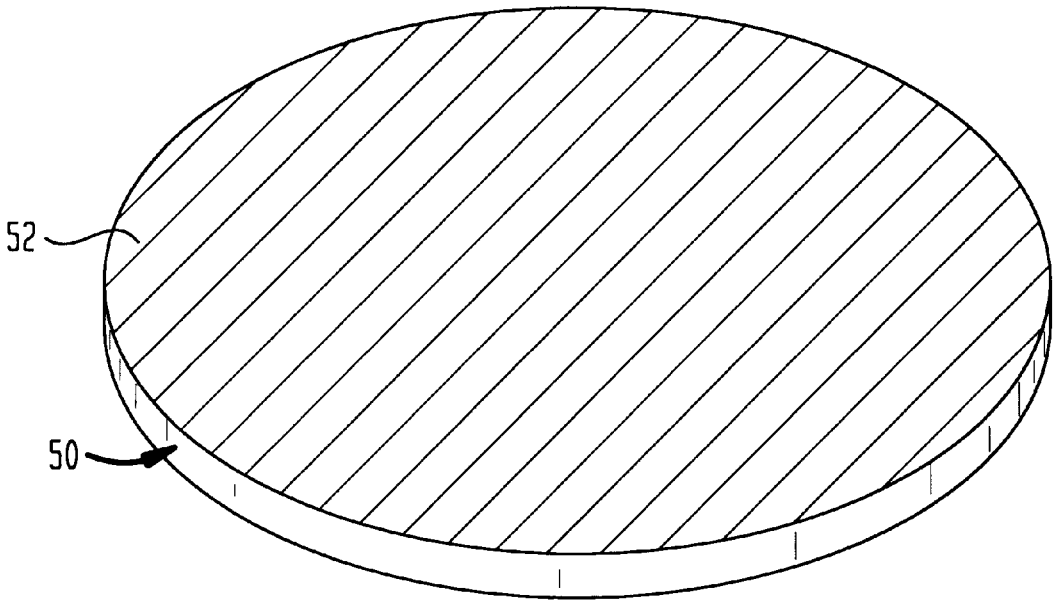
FIG. 3 illustrates a second alternative embodiment of a wafer support utilized in the process of FIGS. 1*a*–1*g*.

FIG. 3 illustrates a second alternative embodiment of a wafer support 50 which can be used in the process of FIGS. 1*a*–1*g*. Like the support 10 illustrated in FIGS. 1*a*–1*g*, the support 50 is a disk made of sapphire, but it can also be made of quartz or a metal plate. In addition, although it is desirable for the support 50 to be circular or disk-shaped, the support 50 can be any shape.

The support 50 has first surface 52. The first surface 52 contains a ground or etched line pattern formed thereon as grooves. As shown in FIG. 3, the ground or etched line pattern contains a plurality of diagonal lines spanning the entire region of the first surface 52. The ground or etched line pattern can be provided by a conventional grinder or etching process. When the first surface of the mounting material is adhered to the first surface 52 of the wafer support 50, the ground or etched line pattern allows air bubbles to escape while the mounting material is being applied to the support 50. This ensures that the mounting material is planar to the support 50.

Figure 4:
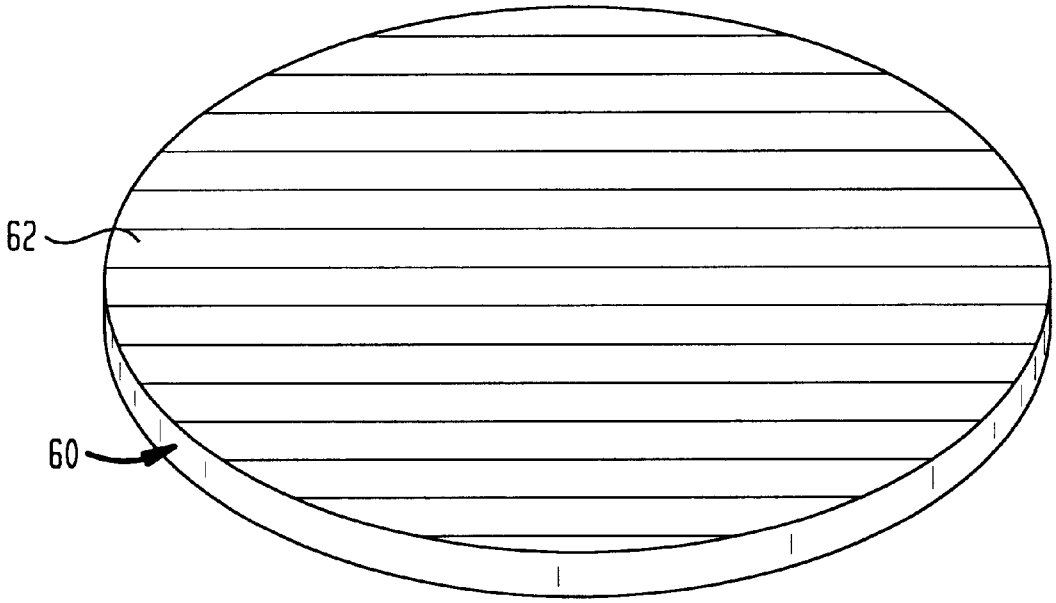
FIG. 4 illustrates a third alternative embodiment of a wafer support utilized in the process of FIGS. 1*a*–1*g*.

FIG. 4 illustrates a third alternative embodiment of a wafer support 60 which can be used in the process of FIGS. 1*a*–1*g*. Like the support 10 illustrated in FIGS. 1*a*–1*g*, the support 60 is a disk made of sapphire, but it can also be made of quartz or a metal plate. In addition, although it is desirable for the support 60 to be circular or disk-shaped, the support 60 can be any shape.

The support 60 has first surface 62. The first surface 62 contains a matt finish. As shown in FIG. 4, the matt finish contains a plurality of finely spaced parallel lines spanning the entire region of the first surface 62 formed as grooves. The matt finish can be provided by a conventional grinder. When the first surface of the mounting material is adhered to the first surface 62 of the wafer support 60, the matt finish allows air bubbles to escape while the mounting material is being applied to the support 60. This ensures that the mounting material is planar to the support 60.

The present invention utilizes a mounting material having a thermal release film to adhere a laser wafer to a wafer support during a semiconductor fabrication process such as the thinning process. After undergoing the fabrication process, the thermal release film of the mounting material is heated to a release temperature allowing the laser wafer to be readily removed from the wafer support. By using a thermal release film to adhere and then release the wafer, the present invention minimizes breakage of the laser wafers upon their removal from the support. In addition, by avoiding the use of wax, or any other adhesive that leaves a residue on the wafer upon its removal, the present invention does not require a clean up step upon completion of the process. The use of a wafer support having a patterned first surface ensures that the mounting material, and thus, the wafer, remain planar to the support during the fabrication process.

While the invention has been described in detail with reference to laser wafers it should be readily apparent that the present invention can be used with other semiconductor substrates. In addition, the present invention is not to be limited to the thinning or polishing process and that the present invention can be utilized with other manufacturing or semiconductor fabrication processes requiring the mounting of a substrate to a support.

While the invention has been described in detail in connection with the preferred embodiments known at the time, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Accordingly, the invention is not to be seen as limited by the foregoing description, but is only limited by the scope of the appended claims.

What is claimed as new and desired to be protected by Letters Patent of the United States is:

1. A method of holding and releasing a semiconductor wafer during a fabrication process comprising:

adhering a first surface of a thermal release mounting material to a wafer support;

pressing a semiconductor wafer onto a second surface of the mounting material, which is on an opposite side of the mounting material from the first surface, to adhere the semiconductor wafer to the mounting material;

performing a fabrication process on the semiconductor wafer;

heating the mounting material to a release temperature; and removing the semiconductor wafer from the mounting material.

2. The method of claim 1 wherein the semiconductor wafer is a laser wafer and the fabrication process is a polishing process.

3. The method of claim 1 wherein the semiconductor wafer is a laser wafer and the fabrication process is a polishing process.

4. The method of claim 1 further comprising the act of providing a plurality of apertures in the wafer support and wherein the adhering act is performed by adhering the first surface of the thermal release mounting material to a first surface of the wafer support over the apertures.

5. The method of claim 1 further comprising the act of providing an X pattern on a first surface of the wafer support and wherein the adhering act is performed by adhering the first surface of the thermal release mounting material to the first surface of the wafer support over the X pattern.

6. The method of claim 1 further comprising the act of providing a line pattern on a first surface of the wafer support and wherein the adhering act is performed by adhering the first surface of the thermal release mounting material to the first surface of the wafer support over the line pattern.

7. The method of claim 1 further comprising the act of providing a matt finish on a first surface of the wafer support and wherein the adhering act is performed by adhering the first surface of the thermal release mounting material to the first surface of the wafer support over the matt finish.

8. A method of holding and releasing a semiconductor wafer during a fabrication process comprising:

pressing a semiconductor wafer onto a first adhesion surface of a thermal release mounting material;

adhering a second surface of the mounting material, which is on an opposite side of the mounting material from the first surface, to a wafer support;

performing a fabrication process on the semiconductor wafer;

heating the mounting material to a release temperature; and removing the semiconductor wafer from the mounting material.

9. The method of claim 8 wherein the semiconductor wafer is a laser wafer and the fabrication process is a thinning process.

10. The method of claim 8 wherein the semiconductor wafer is a laser wafer and the fabrication process is a polishing process.

11. The method of claim 8 further comprising the act of providing a plurality of apertures in the wafer support and wherein the adhering act is performed by adhering the second surface of the thermal release mounting material to a first surface of the wafer support over the apertures.

12. The method of claim 8 further comprising the act of providing an X pattern on a first surface of the wafer support and wherein the adhering act is performed by adhering the second surface of the thermal release mounting material to the first surface of the wafer support over the X pattern.

13. The method of claim 8 further comprising the act of providing a line pattern on a first surface of the wafer support and wherein the adhering act is performed by adhering the second surface of the thermal release mounting material to the first surface of the wafer support over the line pattern.

14. The method of claim 8 further comprising the act of providing a matt finish on a first surface of the wafer support and wherein the adhering act is performed by adhering the second surface of the thermal release mounting material to the first surface of the wafer support over the matt finish.

15. An apparatus for holding a semiconductor wafer during a fabrication process comprising:

a wafer support, said wafer support having a first support surface; and a mounting material, said material having a first adhesion surface to be adhered to said first support surface, said mounting material having a second adhesion surface, which is on an opposite side of said mounting material from said first adhesion surface, to be adhered to a semiconductor wafer, said second adhesion surface having a thermal release film for releasing an adhered wafer when heated.

16. The apparatus of claim 15 wherein said wafer support includes a second support surface, which is on an opposite side of said support from said first support surface, wherein a plurality of apertures are formed within said support and extending between said first and second support surfaces.

17. The apparatus of claim 15 wherein said wafer support surface has an X pattern formed within said first support surface.

18. The apparatus of claim 17 wherein said X pattern is etched into said first support surface.

19. The apparatus of claim 17 wherein said X pattern is ground into said first support surface.

20. The apparatus of claim 15 wherein said wafer support has a line pattern formed within said first support surface.

21. The apparatus of claim 20 wherein said line pattern comprises a plurality of diagonal lines.

22. The apparatus of claim 20 wherein said line pattern is etched into said first support surface.

23. The apparatus of claim 20 wherein said line pattern is ground into said first support surface.

24. The apparatus of claim 15 wherein said wafer support has a matt finish formed within said first support surface.

25. The apparatus of claim 24 wherein said matt finish comprises a plurality of parallel lines.

26. The apparatus of claim 15 wherein said mounting material is comprised of nylon.

27. The apparatus of claim 15 wherein said wafer support is comprised of sapphire.

28. The apparatus of claim 15 wherein said wafer support is comprised of quartz.

29. The apparatus of claim 15 wherein said wafer support is comprised of a metal plate.

* * * * *